US011025009B2

(12) United States Patent
Shimonishi et al.

(10) Patent No.: US 11,025,009 B2
(45) Date of Patent: Jun. 1, 2021

(54) CIRCUIT SUBSTRATE MOUNTED CABLE CONNECTOR

(71) Applicant: Molex, LLC, Lisle, IL (US)

(72) Inventors: Satoshi Shimonishi, Yamato (JP); Toshiya Oda, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/724,376

(22) Filed: Dec. 22, 2019

(65) Prior Publication Data

US 2020/0212628 A1 Jul. 2, 2020

(30) Foreign Application Priority Data

Dec. 27, 2018 (JP) ..... JP2018-245717

(51) Int. Cl.

| | |
|---|---|
| ***H01R 12/88*** | (2011.01) |
| ***H01R 13/627*** | (2006.01) |
| ***H01R 13/11*** | (2006.01) |
| ***H01R 13/639*** | (2006.01) |
| ***H01R 12/57*** | (2011.01) |

(52) U.S. Cl.

CPC ..... *H01R 13/639* (2013.01); *H01R 12/57* (2013.01); *H01R 12/88* (2013.01); *H01R 13/11* (2013.01); *H01R 13/627* (2013.01)

(58) Field of Classification Search

CPC ..... H01R 12/75; H01R 12/71; H01R 12/57; H01R 12/88; H01R 12/718; H01R 12/716; H01R 24/00; H01R 24/005; H01R 13/11; H01R 13/627; H01R 13/6271; H01R 13/6278; H01R 13/639; H01R 13/629; H01R 13/62905; H01R 13/62922

See application file for complete search history.

(56) References Cited

U.S. PATENT DOCUMENTS

| | | | | |
|---|---|---|---|---|
| 4,426,125 A * | 1/1984 | Crawford | H01R 12/675 439/404 |
| 2010/0267269 A1* | 10/2010 | Umehara | H01R 13/627 439/345 |
| 2011/0306229 A1* | 12/2011 | Katsui | H01R 24/005 439/345 |

FOREIGN PATENT DOCUMENTS

| | | |
|---|---|---|
| CN | 101667695 A | 3/2010 |
| CN | 107069348 A | 8/2017 |
| CN | 108232505 A | 6/2018 |
| JP | 4115983 B2 | 7/2008 |
| JP | 2012033347 A | 2/2012 |
| JP | 6050420 B2 | 12/2016 |
| KR | 100652199 B1 | 12/2006 |

* cited by examiner

*Primary Examiner* — Vanessa Girardi

(57) ABSTRACT

A first connector has first rear engagement parts exposed toward the rear of the first connector, along with first front engagement parts exposed towards the front of the first connector. A second connector has second rear engagement parts and second front engagement parts. In the mating state between the first connector and the second connector, the second rear engagement parts are disposed on the rear side of the first rear engagement parts so as to engage with the first rear engagement parts, while the second front engagement parts are disposed on the front side of the first front engagement parts so as to engage with the first front engagement parts.

5 Claims, 15 Drawing Sheets

CIRCUIT SUBSTRATE MOUNTED CABLE CONNECTOR

RELATED APPLICATIONS

This application claims priority to Japanese Application No. 2018-245717 filed on Dec. 27, 2018, which is incorporated herein by reference in its entirety.

TECHNICAL FIELD

The present disclosure relates to a connector assembly.

BACKGROUND ART

Patent Document 1 discloses a connector assembly for electrically connecting a circuit substrate and a cable. In Patent Document 1, the circuit substrate mounted on a connector (referred to as a "substrate connector") can mate with a connector for holding a cable terminal (referred to as a "cable connector") in the vertical direction. The cable connector is disposed on the upper side of the substrate connector and is fitted in the left and right side walls of the substrate connector. A recess is formed on the inner surface of the side walls of the substrate connector, while a projection engaging with the recess of the substrate connector is formed on the left and right side faces of the cable connector. This recess and projection restrict separation of the two connectors.

Patent Document: Patent Document 1: JP 4115983 B

SUMMARY

When a cable connector mates with a substrate connector, a force pulling a cable diagonally rearward may act. In order to prevent such a force from separating the two connectors, it is effective to increase an engagement force of the two connectors (degree of engagement of recess and projection). Unfortunately, in the structure of Patent Document 1, when the degree of engagement between the recess and the projection increases, a force required for an operator to mate and separate the two connectors is excessive, deteriorating the workability. That is, in the conventional structure, it is problematically difficult to improve the resistance to the force pulling a cable diagonally rearward while maintaining the workability of the operation of mating and separating the two connectors.

A connector assembly proposed in the present disclosure includes: a first connector which can be mounted on a circuit substrate; and a second connector which is capable of mating with the first connector in the vertical direction and holds a cable terminal provided at the end of a cable, wherein the cable is capable of being connected to the second connector so as to extend rearward. The first connector has a first rear engagement part exposed towards the rear of the first connector, along with a first front engagement part exposed towards the front of the first connector. The second connector has a second rear engagement part and a second front engagement part. In the mating state between the first connector and the second connector, the second rear engagement part is disposed on the rear side of the first rear engagement part so as to engage with the first rear engagement part, while the second front engagement part is disposed on the front side of the first front engagement part so as to engage with the first front engagement part.

This connector assembly can effectively prevent a first connector and a second connector from separating if a cable is pulled diagonally rearward, for example. Moreover, this can facilitate the operation of engaging the second rear engagement part of the second connector with the first rear engagement part of the first connector.

Note that in this connector assembly, the cable and the cable terminal are not elements of the second connector. When using the second connector, the cable terminal may be held by the second connector.

DETAILED DESCRIPTION OF THE PREFERRED EMBODIMENTS

Figure 1:
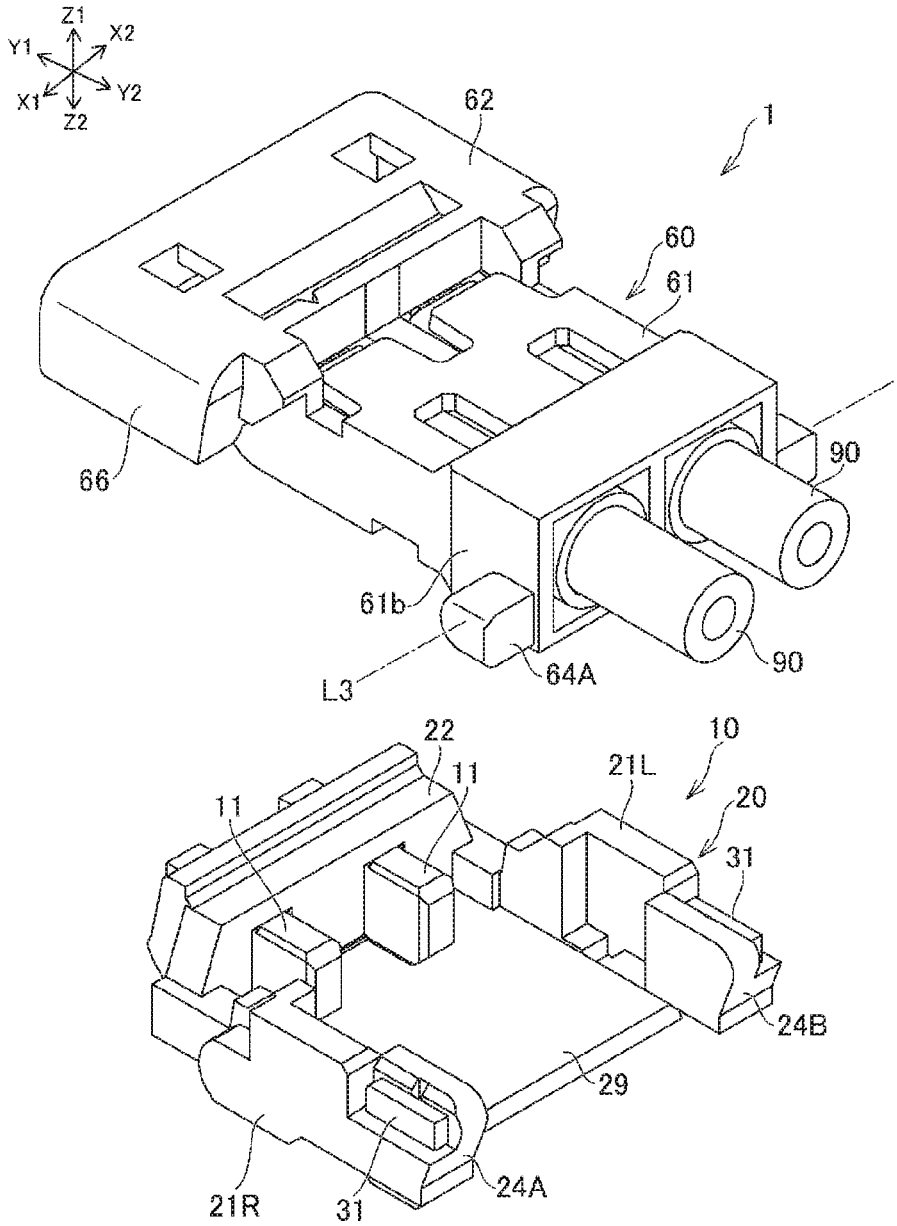
FIG. 1 is an exploded perspective view of one example of a connector assembly proposed by the present disclosure.

A connector assembly proposed in the present disclosure is described below. The present specification describes a connector assembly 1 illustrated in FIG. 1 and the like as an example of a connector assembly. In the following description, the directions indicated by X1 and X2 in FIG. 1 are respectively referred to as right and left, while the directions indicated by Y1 and Y2 in FIG. 1 are respectively referred to as forward and backward. Moreover, the directions indicated by Z1 and Z2 are respectively referred to as up and down. While these directions are used to describe the relative positional relationships of parts, members, and sections that make up a connector assembly, they do not limit the orientation of the connector assembly 1 when used.

As illustrated in FIG. 1, the connector assembly 1 has a first connector 10 and a second connector 60. The two connectors 10 and 60 can mate with each other in the anteroposterior direction. The connector assembly 1 is a connector assembly for electrically connecting a circuit substrate 101 (see FIGS. 2A and 2B) and multiple cables 90. The first connector 10 is a connector mounted on the circuit substrate 101, while the second connector 60 is a connector with the cable 90 connected thereto.

As illustrated in FIG. 1, the first connector 10 may have a housing 20, along with terminals 11 installed in the housing 20. The housing 20 is, for example, integrally molded of a resin. The terminals 11 are formed of a conductive material (for example, copper) and connected to a conductive pad formed on the circuit substrate 101. For example, the terminals 11 are soldered to the conductive pad. The first connector 10 may have multiple terminals 11 arranged in the left and right direction. While the number of the terminals 11 is, for example, two, as illustrated in FIG. 1, the number may be one or three. The housing 20 may have left and right side walls 21R, 21L formed in the anteroposterior direction, along with a front wall 22 formed between the frontmost parts of the left and right side walls 21R, 21L. The terminals 11 are fixed to the front wall 22. Moreover, the housing 20 may have a bottom 29 formed between the lower edges of the left and right side walls 21R, 21L. The housing 20 opens upward and rearward.

A hole 22*a* (see FIG. 6A) penetrating through the front wall 22 in the anteroposterior direction is formed in the front wall 22. The terminals 11 are fixed inside this hole 22*a*. The front and rear parts of the terminals 11 respectively protrude forward and rearward from the front wall 22. The terminals 11, for example, are pressed into the hole 22*a* and fixed. Unlike this, the terminals 11 may be insert molded in the first housing 20. That is, in the process of molding the first housing 20 from molten resin, the terminals 11 may be solidified with the resin.

Figure 7A:
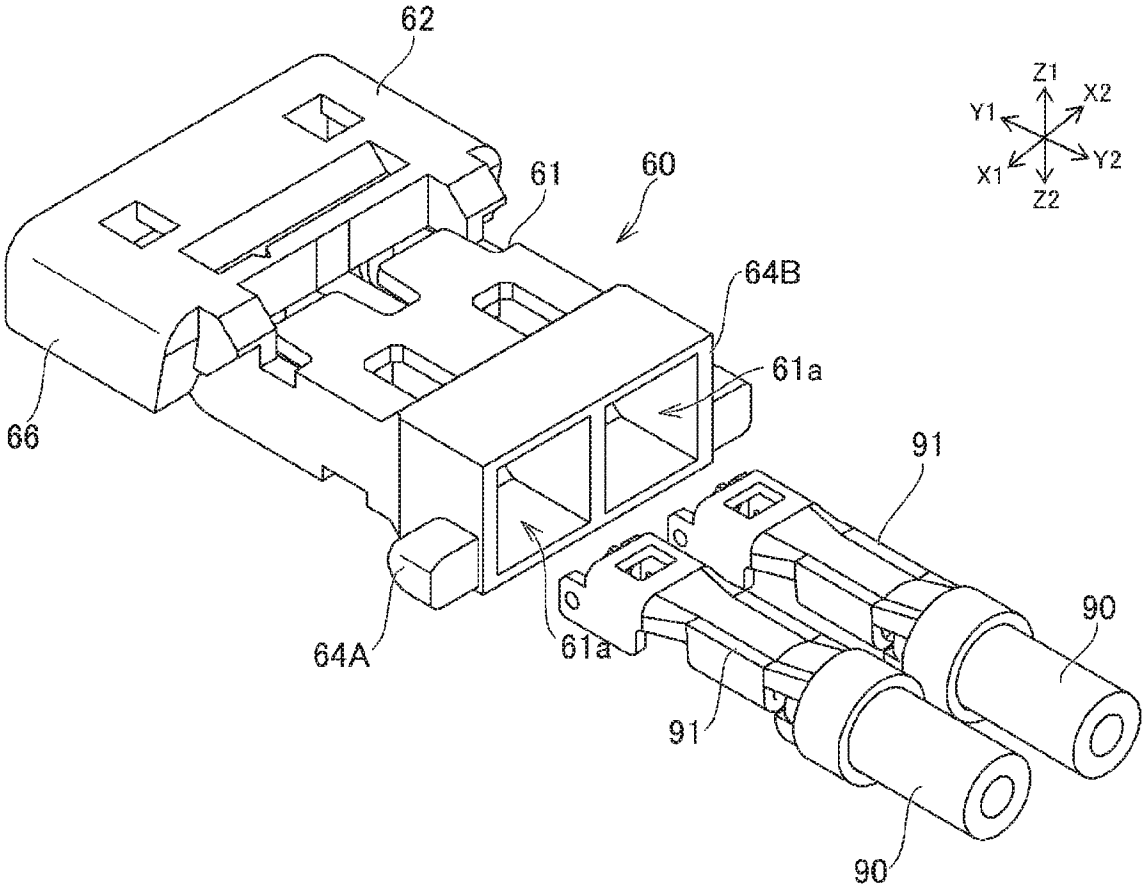
FIG. 7A is an exploded perspective view of a second connector.

As illustrated in FIGS. 1 and 7A, the second connector 60 may hold a cable terminal 91 installed at the end of each cable 90. The cables 90 are connected to the second connector 60 so as to extend rearward from the second connector 60. Multiple cables 90 arranged in the left and right direction may be connected to the second connector 60. While the number of the cables 90 connected to the second connector 60 is, for example, two, the number may be one or three. In the mating state between two connectors 10, 60, multiple cable terminals 91 are respectively connected to multiple terminals 11 provided in the first connector 10.

As illustrated in FIG. 7A, the second connector 60 is, for example, integrally molded of resin. The second connector 60 may have a terminal holding part 61 for holding multiple cable terminals 91. A holding hole 61*a* extending from the rear end towards the front side thereof extend is formed at the terminal holding part 61. The cable terminals 91 are inserted into this holding hole 61*a* and fixed. The holding hole 61*a* opens downward at the frontmost part of the terminal holding part 61 (see FIG. 7B).

In the mating state between the first connector 10 and the second connector 60, the terminal holding part 61 of the second connector is disposed between the left and right side walls 21R, 21L of the first connector 10. In addition, the terminals 11 are fitted in the holding hole 61*a* so as to contact the frontmost part of the cable terminal 91. The shape of the cable terminals 91 will be described below.

As illustrated in FIG. 1, the first connector 10 (specifically, the housing 20) may have first rear engagement parts 24A, 24B. The first rear engagement parts 24A, 24B are formed on the left and right side walls 21R, 21L. Specifically, the first rear engagement parts 24A, 24B are formed at the rear ends of the left and right side walls 21R, 21L. In addition, the first rear engagement parts 24A, 24B are exposed towards the rear of the first connector 10. That is, as seen from the back of the first connector 10, no part of the first connector 10 overlaps the first rear engagement parts 24A, 24B. Moreover, as illustrated in FIGS. 2B and 6B, the first connector 10 (specifically, the housing 20) may have first front engagement parts 23A, 23B. The first front engagement parts 23A, 23B are, for example, formed at the front surface of the front wall 22 and exposed towards the front of the first connector 10. Two first front engagement parts 23A, 23B separated in the left and right direction may be formed on the front wall 22. The number of the first front engagement parts 23A, 23B is not limited to two and, for example, may be one or three or more.

Figure 7B:
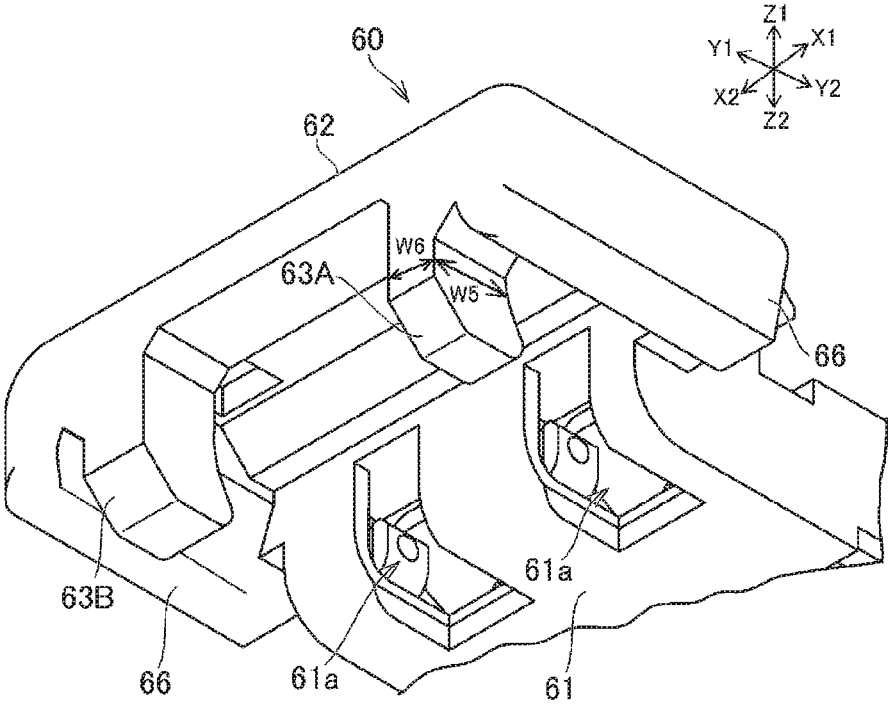
FIG. 7B is a perspective view illustrating the front side of the second connector.

In contrast, as illustrated in FIG. 1, the second connector 60 may have second rear engagement parts 64A, 64B at the rear part of the second connector 60. The second rear engagement parts 64A, 64B, for example, respectively protrude outward in the left and right direction from the left and right side faces 61*b* of the terminal holding part 61. Moreover, as illustrated in FIGS. 2B and 7B, the second connector 60 may have second front engagement parts 63A, 63B. The second connector 60 has a front extension part 62 extending forward from the terminal holding part 61. The second front engagement parts 63A, 63B are, for example, formed at the front edge of the front extension part 62 so as to extend downward from the front extension part 62.

Figure 2A:
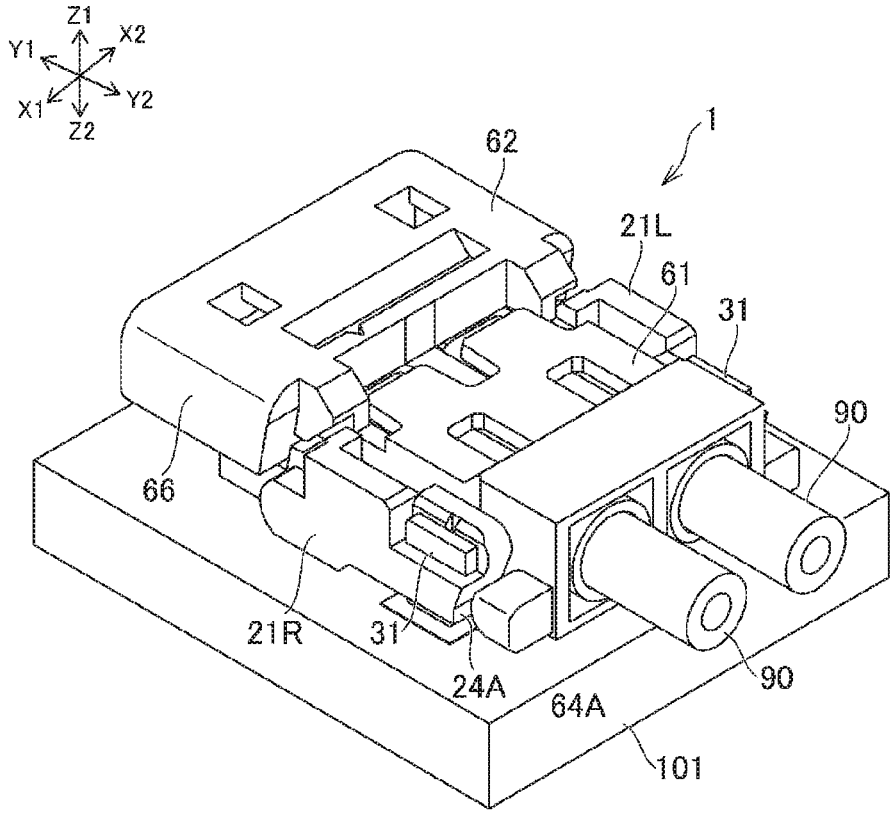
FIG. 2A is a perspective view of the connector assembly.
Figure 2B:
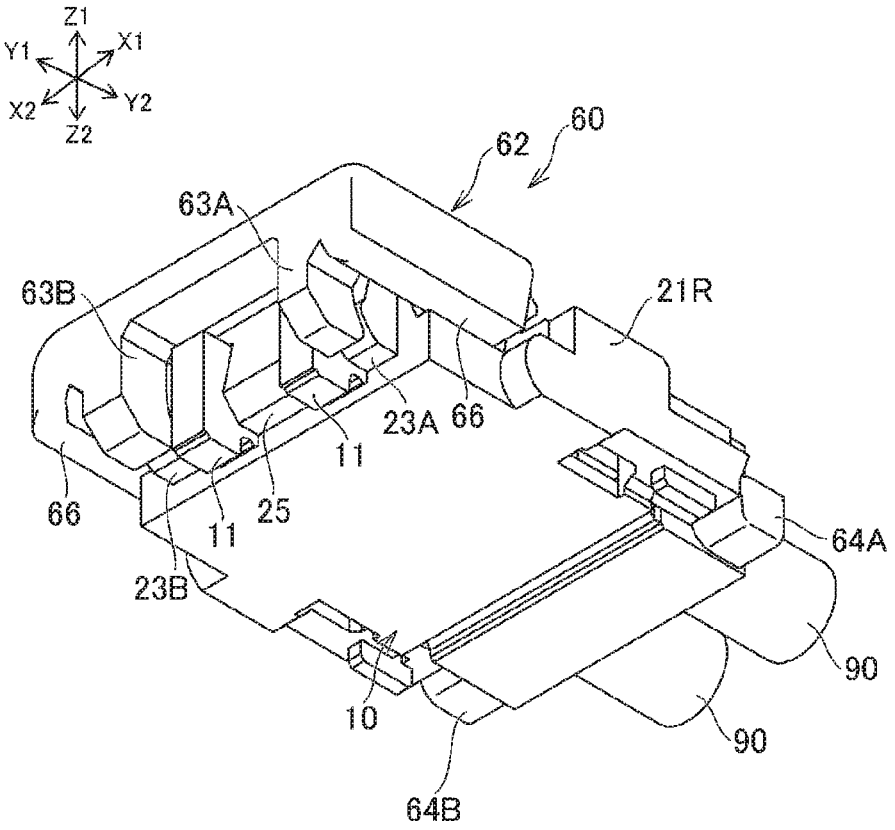
FIG. 2B is a perspective view of the connector assembly.

As illustrated in FIGS. 1 and 2A, the second rear engagement parts 64A, 64B are respectively disposed on the rear side of the first rear engagement parts 24A, 24B so as to engage with the second rear engagement parts 24A, 24B. Specifically, the front end of the second rear engagement parts 64A, 64B is disposed on the lower side of the below-mentioned inclined surface 24*c* (see FIG. 4A) formed in the first rear engagement parts 24A, 24B. Moreover, as illustrated in FIG. 2B, in the mating state between the two connectors 10, 60, the second front engagement parts 63A, 63B are respectively disposed on the front side of the first front engagement parts 23A, 23B so as to engage with the first front engagement parts 23A, 23B. That is, the lowermost part of the second front engagement parts 63A, 63B is disposed on the lower side of the below-mentioned contact surface 23*a* (see FIG. 6B) formed in the first front engagement parts 23A, 23B. Therefore, in the mating state between the connectors 10, 60, the first connector 10 is sandwiched by the second front engagement parts 63A, 63B and the second rear engagement parts 64A, 64B of the second connector 60 in the anteroposterior direction.

Figure 3A:
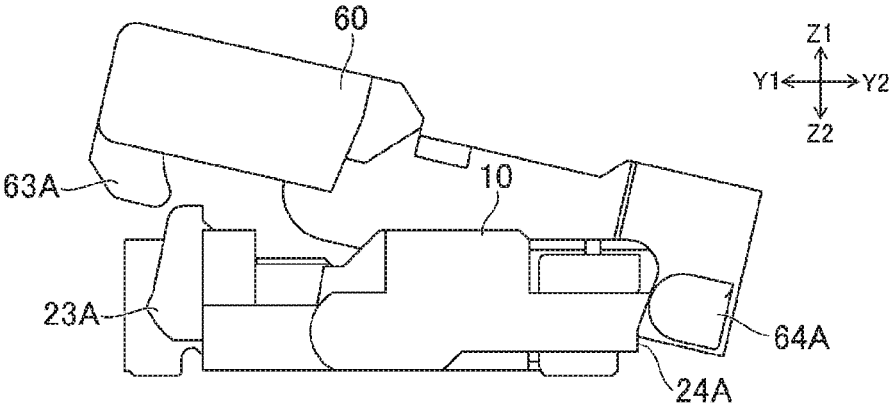
FIG. 3A is a diagram illustrating the mating process of two connectors which form the connector assembly.
Figure 3B:
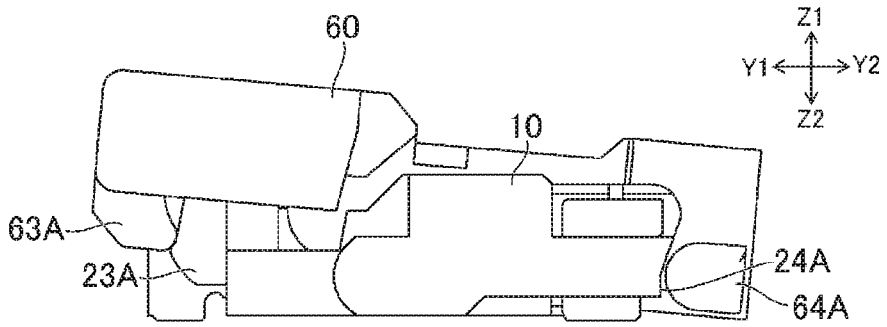
FIG. 3B is a diagram illustrating the mating process of two connectors which form the connector assembly.

The second connector 60 can rotate relative to the first connector 10 about the second rear engagement parts 64A, 64B engaging with the first rear engagement parts 24A, 24B. Specifically, in the process of mating the connectors 10, 60, the second connector 60 is first disposed in a position so as to be inclined to the first connector 10 such that the second rear engagement parts 64A, 64B engage with the first rear engagement parts 24A, 24B (see FIG. 3A). When the front part of the second connector 60 is lowered centering around the second rear engagement parts 64A, 64B, the second front engagement parts 63A, 63B abut the front surface of the first front engagement parts 23A, 23B (see FIG. 3B) and slide downward on the front surface (the below-mentioned guide surface 23*b*) of the first front engagement parts 23A, 23B. In addition, the lowermost part of the second front engagement parts 63A, 63B reaches the lower side of the lower surface (contact surface 23*a*) of the first front engagement parts 23A, 23B (see FIG. 3C). In the process of separating the connectors 10, 60, in contrast to the mating process, the front part of the second connector 60 is raised centering around the second rear engagement parts 64A, 64B.

In this way, because the second rear engagement parts 64A, 64B are respectively disposed on the rear side of the first rear engagement parts 24A, 24B so as to engage with the first rear engagement parts 24A, 24B, an operator can rotate the second connector 60 about the second rear engagement parts 64A, 64B. By rotating the second connector 60, the operator can engage and disengage the second front engagement parts 63A, 63B as well as the first front engagement parts 23A, 23B.

Figure 4A:
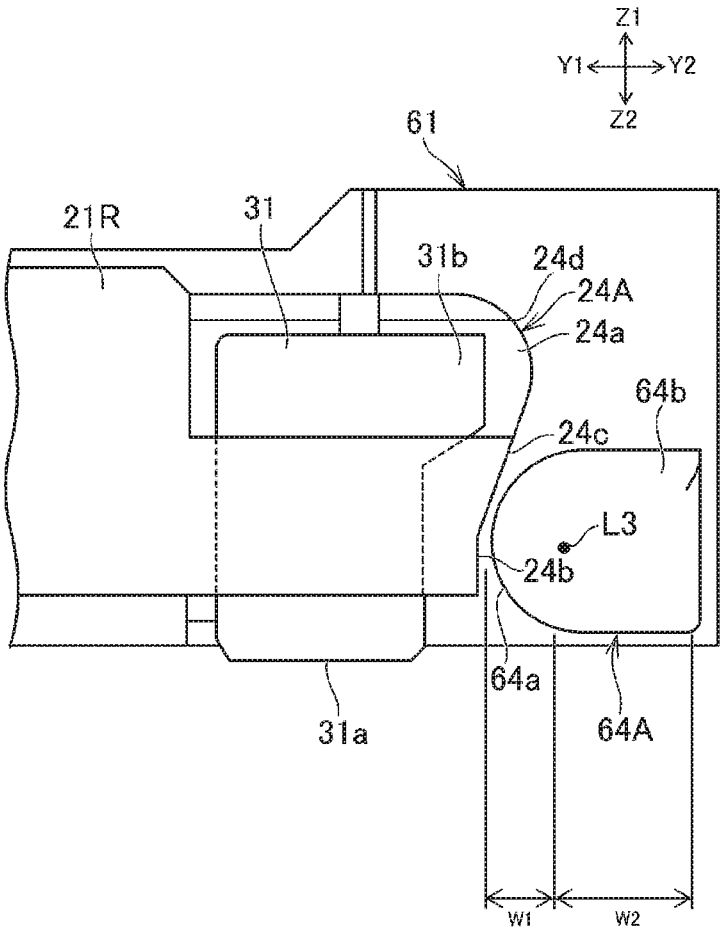
FIG. 4A is a side view illustrating the rear part of the connector assembly.
Figure 4B:
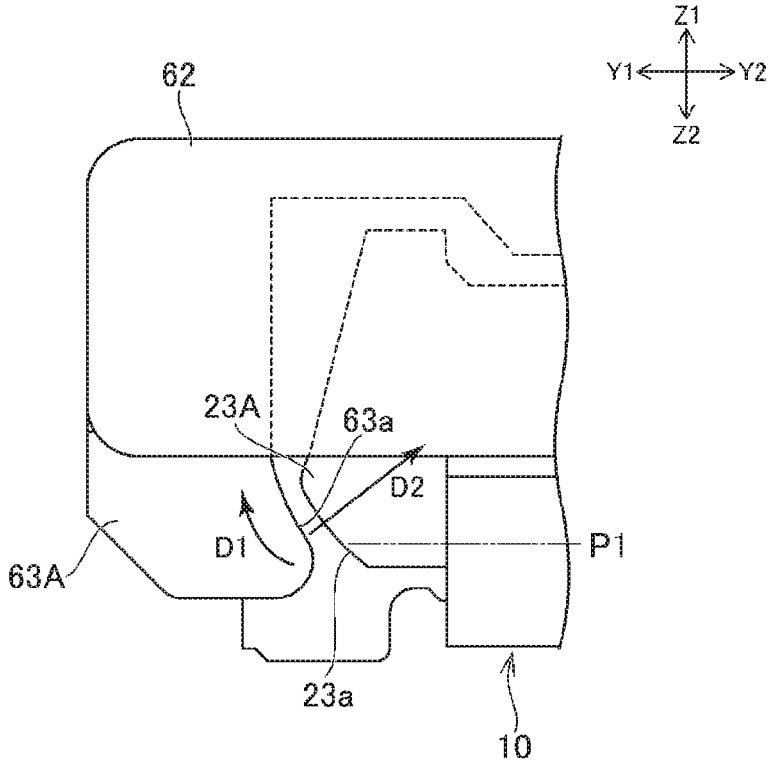
FIG. 4B is a side view illustrating the front part of the connector assembly.

Because the second front engagement parts 63A, 63B are disposed on the front side of the first front engagement parts 23A, 23B, when the second front engagement parts 63A, 63B and the first front engagement parts 23A, 23B are disengaged, the second front engagement parts 63A, 63B move in the direction of the arrow D1 illustrated in FIG. 4B (diagonally forward and upward). The force pulling the cable 90 diagonally rearward and upward acts on the second front engagement parts 63A, 63B and the first front engagement parts 23A, 23B. When the cable 90 is pulled diagonally rearward and upward, the force in the direction indicated by D2 of FIG. 4B (diagonally rearward and upward) acts on the second front engagement parts 63A, 63B. That is, the direction D2 of the force acting when the cable 90 is pulled is significantly different from the direction D1 for disengaging the second front engagement parts 63A, 63B and the first front engagement parts 23A, 23B. As a result, two connectors 10, 60 can be effectively prevented from separating when the cable 90 is pulled diagonally rearward and upward.

Moreover, in the mating state between the connectors 10, 60, the second rear engagement parts 64A, 64B are respectively disposed on the rear side of the first rear engagement parts 24A, 24B so as to engage with the first rear engagement parts 24A, 24B. As mentioned below, the upper part 24*a* (see FIG. 4A) of the first rear engagement parts 24A, 24B is disposed above the second rear engagement parts 64A, 64B. According to this structure, when the cable 90 is diagonally forward and upward, the upper part 24*a* of the first rear engagement parts 24A, 24B can restrict the movement of the second rear engagement parts 64A, 64B, effectively preventing the two connectors 10, 60 from separating.

As mentioned above, the first rear engagement parts 24A, 24B of the first connector 10 are exposed towards the rear of the first connector 10. That is, as seen from the back of the first connector 10, no part of the first connector 10 overlaps the first rear engagement parts 24A, 24B. That is, when seeing the first connector 10 from right behind, the operator can see the first rear engagement parts 24A, 24B. As a result, in the operation process of mating the second connector 60 with the first connector 10, the operator can easily abut the second rear engagement parts 64A, 64B against the first rear engagement parts 24A, 24B, thereby improving the workability.

In the example of the first connector 10, the first rear engagement parts 24A, 24B serve as the rear end surfaces of the left and right side walls 21R, 21L. As a result, with the second rear engagement parts 64A, 64B engaging with the first rear engagement parts 24A, 24B, the second rear engagement parts 64A, 64B are laterally exposed, allowing the operator to easily confirm the positions of the second rear engagement parts 64A, 64B. Therefore, this can particularly facilitate the operation of abutting the second rear engagement parts 64A, 64B against the first rear engagement parts 24A, 24B.

Moreover, because the first rear engagement parts 24A, 24B serve as the rear end surfaces of the left and right side walls 21R, 21L, when something unintended by the operator is caught by the cable 90 and the cable 90 is pulled rightward or leftward, the distance between the part for receiving the force (portion of the cable 90) and the first rear engagement parts 24A, 24B becomes closer. As a result, the resistance to moments generated in the connectors 10, 60 caused by such a force can be improved.

Figure 3C:
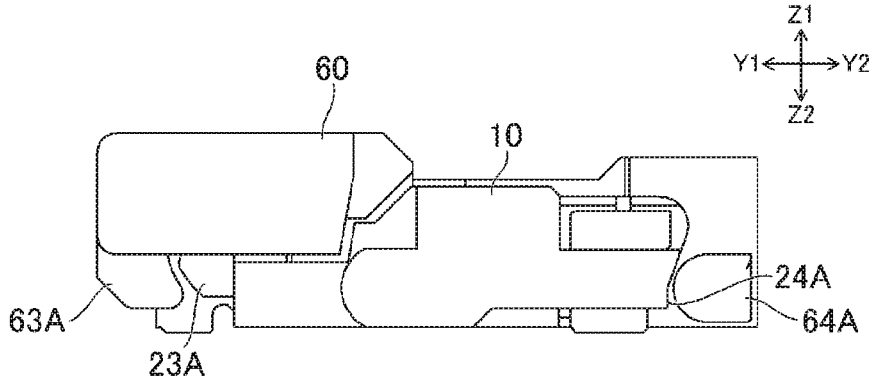
FIG. 3C is a diagram illustrating the mating process of two connectors which form the connector assembly.

As illustrated in FIG. 3C, in the mating state between the two connectors 10, 60, a gap may be formed between the first front engagement parts 23A, 23B (the below-mentioned contact surface 23*a* (FIG. 4B)) and the second front engagement parts 63A, 63B, while a gap may be formed between the first rear engagement parts 24A, 24B and the second rear engagement parts 64A, 64B (the below-mentioned contact surface 64*a*). According to this structure, in the mating state between the two connectors 10, 60, as well as in the process of reaching the mating state, excessive loads can be prevented from being applied between the first front engagement parts 23A, 23B and the second front engagement parts 63A, 63B, in addition to excessive loads being prevented from being applied between the first rear engagement parts 24A, 24B and the second rear engagement parts 64A, 64B.

The positions of the first rear engagement parts 24A, 24B are not limited to the example of the first connector 10. For example, the first rear engagement parts 24A, 24B may be formed on the inner surfaces of the left and right side walls 21R, 21L. A step, for example, may be formed on the inner surfaces of the left and right side walls 21R, 21L, such that this step may form the surface which is exposed rearward. In addition, this surface which is exposed rearward may function as the first rear engagement parts 24A, 24B.

Rear engagement parts 24A, 24B, 64A, and 64B will hereinafter be described in detail. Because the shape of two first rear engagement parts 24A, 24B, as well as that of the shape of two second rear engagement parts 64A, 64B, is symmetric, the rear engagement parts 24A, 64A formed on the right will hereinafter be mainly described. The descriptions of the rear engagement parts 24A, 64A formed on the right also apply to the rear engagement parts 24B, 64B formed on the left.

As illustrated in FIG. 4A, the second rear engagement part 64A may have the contact surface 64*a* which abuts the first rear engagement part 24A and is curved when seen from the side of the second connector 60. This contact surface 64*a* is arc shaped about the straight line L3 (see FIG. 1) in the left and right direction which passes through the second rear engagement part 64A. The contact surface 64*a*, for example, forms a semicircle about the straight line L3. In the operation process of mating the second connector 60 with the first connector 10, as well as the operation process of separating the first connector 10 and the second connector 60, this shape of the contact surface 64*a* enables the second connector 60 to smoothly rotate about the left and right second rear engagement parts 64A, 64B.

As illustrated in FIG. 4A, the first rear engagement part 24A may have the upper part 24*a* which is disposed above the contact surface 64*a* of the second rear engagement part 64A. The presence of the upper part 24*a* can prevent the first rear engagement part 24A from being unintentionally separated from the second rear engagement part 64A.

As illustrated in FIG. 4A, the first rear engagement part 24A may have a vertical surface 24*b*, along with the first inclined surface 24*c* which extends diagonally rearward and upward from the vertical surface 24*b*. The contact surface 64*a* of the second rear engagement part 64A faces the vertical surface 24*b* along with the lower part of the first inclined surface 24*c*. In the operation process of engaging the second rear engagement part 64A and the first rear engagement part 24A, when the second rear engagement part 64A abuts the upper part of the first inclined surface 24*c* of the first rear engagement part 24A, the second rear engagement part 64A is guided downward by the first inclined surface 24*c*. That is, the first inclined surface 24*c* may function as a guide surface.

Moreover, as illustrated in FIG. 4A, the first rear engagement part 24A may have a second inclined surface 24*d* which extends from the upper part of the first inclined surface 24*c*. The second inclined surface 24*d* is inclined in front of the straight line in the vertical direction. That is, the second inclined surface 24*d* extends diagonally forward and upward from the upper part of the first inclined surface 24*c*. Specifically, the second inclined surface 24*d* extends diagonally forward and upward while being curved in an arc shape. Unlike this, the second inclined surface 24*d* may linearly extend diagonally forward and upward from the upper part of the first inclined surface 24*c*.

In the operation process of engaging the second rear engagement part 64A and the first rear engagement part 24A, even when the second rear engagement part 64A approaches the first rear engagement part 24A from the upper side and abuts the upper part 24*a* of the first rear engagement part 24A, the second rear engagement part 64A is guided by the second inclined surface 24*d* so as to slide rearward and be disposed on the rear side of the first rear engagement part 24A. Therefore, the second inclined surface 24*d* can facilitate the operation of engaging the second rear engagement part 64A and the first rear engagement part 24A.

The shape of the first rear engagement part 24A is not limited to the example of the first connector 10. For example, the first rear engagement part 24A may not have the vertical surface 24*b*. In this case, the inclined surface 24*c* may be formed over the entire first rear engagement part 24A, that is, over the entire rear end surface of the right side wall 21R. As yet another example, the first rear engagement part 24A does not necessarily have to have the inclined surface 24*c* as long as it is of a shape which restricts the upward movement of the second rear engagement part 64A. As yet another example, the inclined surface 24*c* linearly extends, but may be curved.

As illustrated in FIG. 4A, the second rear engagement part 64A has a rear part 64*b* which is disposed behind the upper part 24*a* of the first rear engagement part 24A. In doing so, the width of the second rear engagement part 64A in the anteroposterior direction tends to be sufficiently assured, while the strength of the second rear engagement part 64A to the force received from the first rear engagement part 24A tends to be assured. The width W2 in the anteroposterior direction of the rear part 64*b* is, for example, larger than the width W1 in the part with the contact surface (curved surface) 64*a* formed therein.

The structure of the rear engagement parts 24A, 64A is not limited to the example indicated by the connectors 10, 60. For example, the contact surface (arc shaped contact surface) which allows smooth rotation of the second connector 60 may be formed in the first rear engagement part 24A. For example, the first rear engagement part 24A may protrude rearward from the side wall 21R of the first connector 10. In this case, the rear end surface of the first rear engagement part 24A (surface abutting the second rear engagement part) may be curved in an arc shape. Moreover, in this case, the second rear engagement part 64A may not have a curved contact surface. As yet another example, the first rear engagement part 24A may protrude inward from the inner surface of the side wall 21R of the first connector 10. In this case, the rear surface of the first rear engagement part 24A (surface abutting the second rear engagement part) may be curved in an arc shape.

As illustrated in FIG. 1, the first connector 10 may have a reinforcing metal fitting 31 adjacent to the first rear engagement parts 24A, 24B. The reinforcing metal fitting 31 enables the strength of the first rear engagement parts 24A, 24B to increase and, for example, can effectively prevent the first rear engagement parts 24A, 24B from being deformed by the force received from the second rear engagement parts 64A, 64B. The reinforcing metal fitting 31 is, for example, installed in the rear part of each of the left and right side walls 21R, 21L. The reinforcing metal fitting 31 is plate shaped and disposed so as to face the left and right direction.

As illustrated in FIG. 4A, the lower edge 31*a* of the reinforcing metal fitting 31 may be disposed below the lower surface of the first connector 10. The lower edge 31*a* of the reinforcing metal fitting 31 may be installed in the circuit substrate 101. For example, the lower edge 31*a* of the reinforcing metal fitting 31 may be soldered to the circuit substrate 101. According to this structure, the force acting from the second rear engagement part 64A on the first rear engagement part 24A can be prevented from acting on the connection between the terminal 11 and a conductive pad of the circuit substrate 101.

As illustrated in FIG. 4A, when the two connectors 10, 60 mate with each other, the reinforcing metal fitting 31 is disposed in front of the second rear engagement parts 64A, 64B. The position of the upper part 31*b* of the reinforcing metal fitting 31 is higher than the second rear engagement part 64A. Moreover, as in the upper part 24*a* of the first rear engagement part 24A, the upper part 31*b* of the reinforcing metal fitting 31 protrudes rearward.

Figure 8:
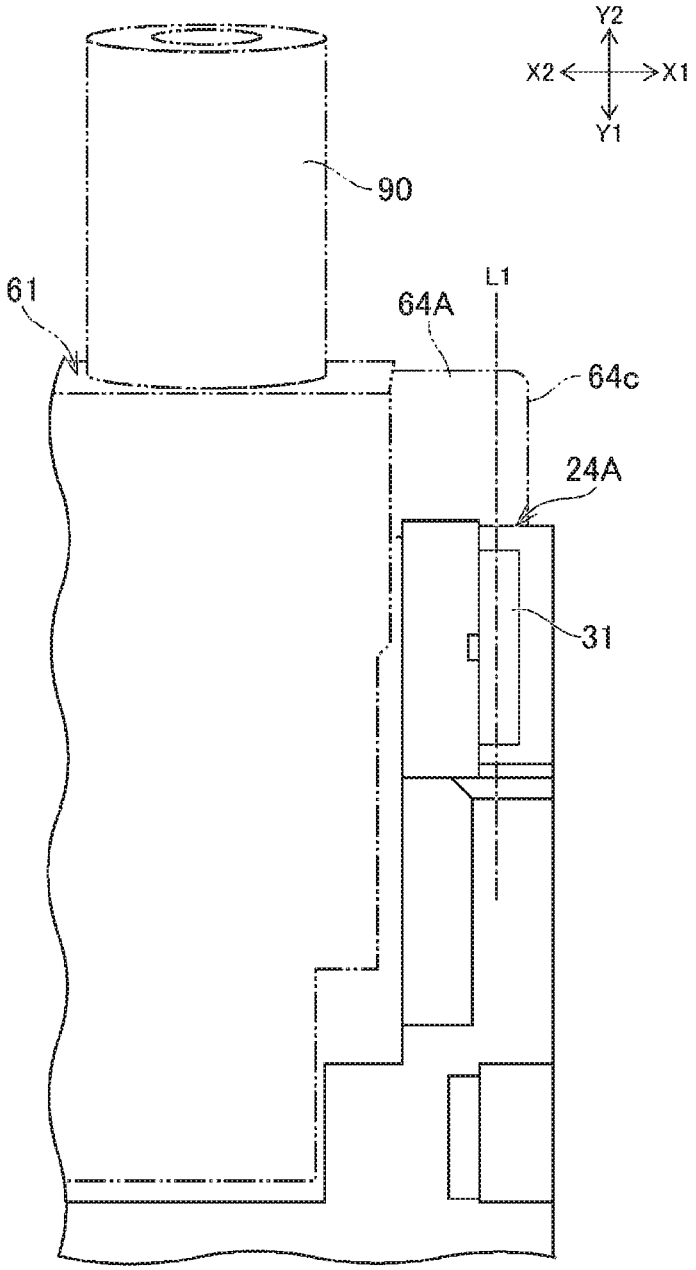
FIG. 8 is a plan view illustrating the state in which the first rear engagement part of the first connector engages with the second rear engagement part of the second connector.

As illustrated in FIG. 8, in a plan view of the connectors 10, 60, the reinforcing metal fitting 31 is disposed so as to be closer to the center of the first connector 10 in the left and right direction compared with the end surface 64*c* of the second rear engagement part 64A (end outward in the left and right direction). In other words, the straight line L1 passing through the reinforcing metal fitting 31 in the anteroposterior direction also passes through the second rear engagement part 64A. According to this disposition of the reinforcing metal fitting 31, the reinforcing metal fitting 31 can effectively receive the force acting from the second rear engagement part 64A on the first rear engagement part 24A.

Figure 6A:
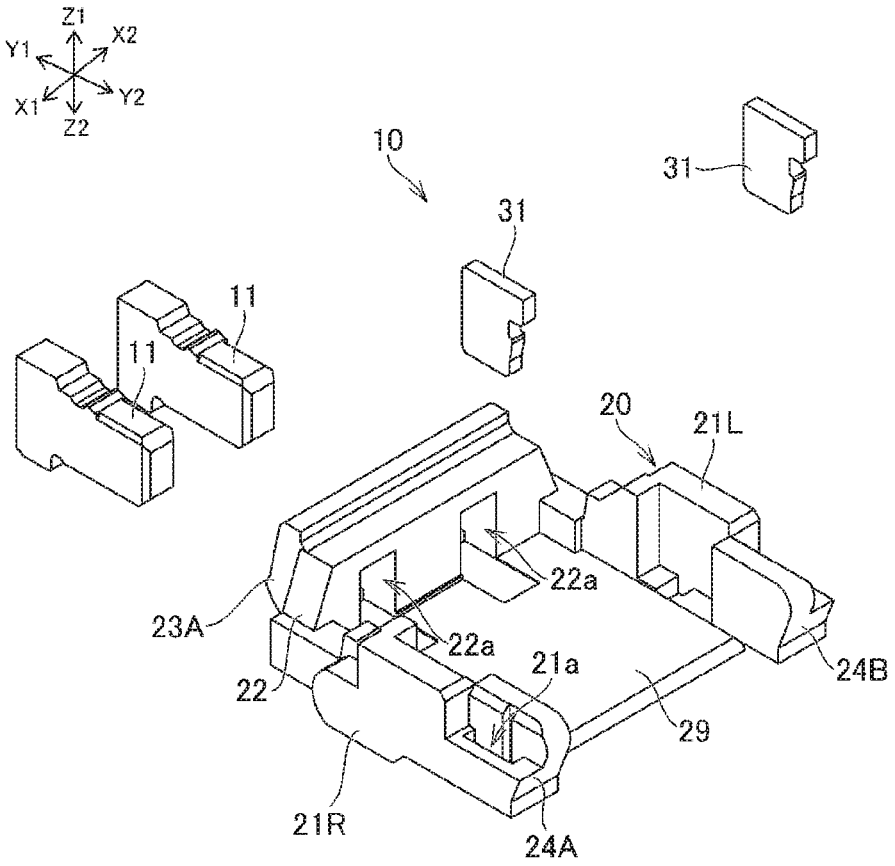
FIG. 6A is an exploded perspective view of a first connector.
Figure 6B:
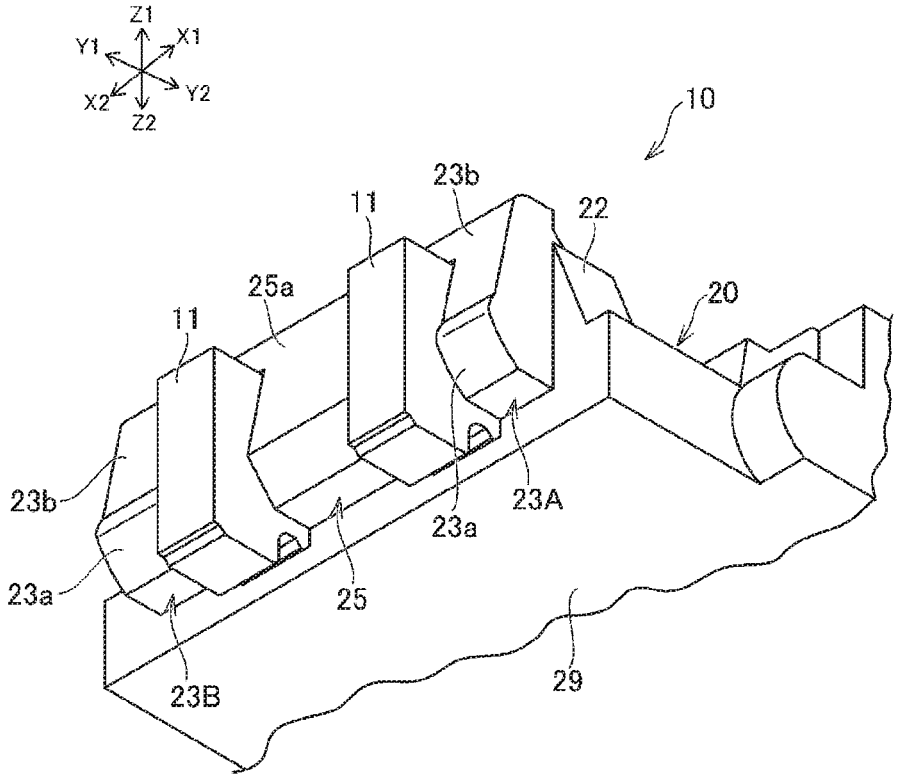
FIG. 6B is a perspective view illustrating the front side of the first connector.

As illustrated in FIG. 6A, a hole 21*a* penetrating through the side wall 21R in the vertical direction is formed in the side wall 21R (see FIG. 6A), while the reinforcing metal fitting 31 is pressed into this hole 21*a* and fixed to the side wall 21R. The reinforcing metal fitting 31 may be formed by insert molding with a housing 20 including the side wall 21R.

As illustrated in FIG. 2B, the first connector 10 may have multiple first front engagement parts 23A, 23B separated in the left and right direction. Similarly, the second connector 60 may have multiple second front engagement parts 63A, 63B separated in the left and right direction. For example, the first connector 10 has two first front engagement parts 23A, 23B, while the second connector 60 has two second front engagement parts 63A, 63B. In the first connector 10, multiple terminals 11 (specifically, two terminals 11) are disposed between the two first front engagement parts 23A, 23B.

The number and position of front engagement parts 23A, 23B, 63A, 63B are not limited to the example of the connectors 10, 60. For example, the first connector 10 may have a first front engagement part formed between the terminals 11, in addition to the two first front engagement parts 23A, 23B or in place of the two first front engagement parts 23A, 23B. In this case, the second connector 60 has a second front engagement part corresponding to the first front engagement part formed between the terminals 11.

Figure 5:
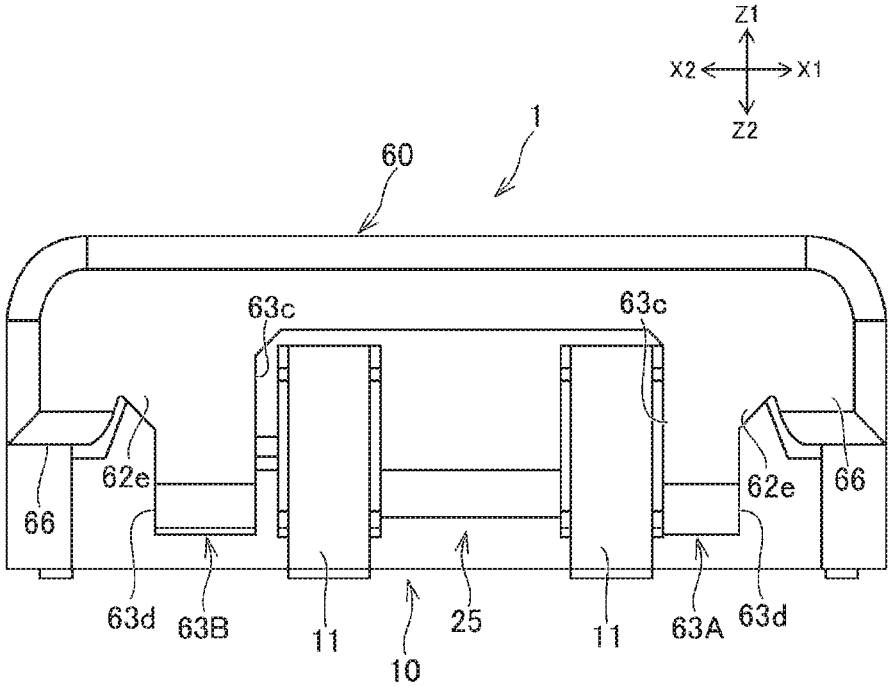
FIG. 5 is a front view of the connector assembly.

The width in the left and right direction of the second front engagement part 63B formed on the left may be slightly larger than the width of the second front engagement part 63A formed on the right (see FIG. 5). Accordingly, the width in the left and right direction of the first front engagement part 23B formed on the left may be slightly larger than the width of the second front engagement part 23A formed on the right. With the exception of this point, the shape of the two first front engagement parts 23A, 23B, as well as that of the two second front engagement parts 63A, 63B, is substantially symmetric. With that, the front engagement parts 23A, 63A formed on the right will hereinafter be mainly described. The descriptions of the front engagement parts 23A, 63A formed on the right also apply to the front engagement parts 23B, 63B formed on the left.

As illustrated in FIG. 4B, the first front engagement part 23A may have the contact surface 23*a* at the lower part thereof. The tip (lower end) of the second front engagement part 63A is disposed below and in front of the contact surface 23*a*, such that the contact surface 23*a* contacts the second front engagement part 63A. For example, when the cable 90 is pulled and the second connector 60 moves rearward, the contact surface 23*a* contacts the second front engagement part 63A. Moreover, when the second connector 60 rotates about the second rear engagement part 64A, the tip (lower end) of the second front engagement part 63A abuts the contact surface 23*a*. Consequently, the second connector 60 can be prevented from unintentionally rotating and separating from the first connector 10. Unlike the example of the connectors 10, 60, the dimensions of the connectors 10, 60 may be designed such that in the mating state between the connectors 10, 60, the contact surface 23*a* continuously contacts the second front engagement part 63A.

As illustrated in FIG. 4B, the contact surface 23*a* may extend diagonally forward and upward from the front surface of the front wall 22. According to this inclination of the first front engagement part 23A, when the force pulling the cable 90 diagonally rearward and upward acts, the direction of the force is substantially vertical to the contact surface 23*a*. As a result, the second connector 60 can effectively be prevented from separating from the first connector 10 when the cable 90 is pulled.

As illustrated in FIG. 4B, the second front engagement part 63A of the second connector 60 may also have a contact surface 63*a* extending diagonally forward and upward at the lower part thereof. In doing so, when the force pulling the cable 90 diagonally rearward and upward acts, a large extent of the contact surface 63*a* of the second front engagement part 63A abuts the contact surface 23*a* of the first front engagement part 23A. Consequently, excessive stress can be prevented from acting on only a portion of the contact surface 63*a*.

Moreover, as illustrated in FIG. 4B, the contact surface 23*a* is inclined to the plane P1 which passes through the rotation center (line L3 illustrated in FIG. 1) of the second connector 60 along with the contact surface 23*a*. Specifically, the contact surface 23*a* is inclined to the upper side with respect to the plane P1. For example, compared with the case in which the contact surface 23*a* is parallel to the plane P1, this structure can facilitate the operation of disengaging the second front engagement part 63A and the first front engagement part 23A.

The structure of the front engagement parts 23A, 63A is not limited to the example of the connectors 10, 60. For example, the contact surface 23*a* of the first front engagement part 23A may be curved in an arc shape. In yet another example, the contact surface 23*a* may, for example, be parallel to the plane P1. In this case, the contact surface 63*a* of the second front engagement part 63A may extend forward and upward diagonally or be curved in an arc shape.

Figure 6C:
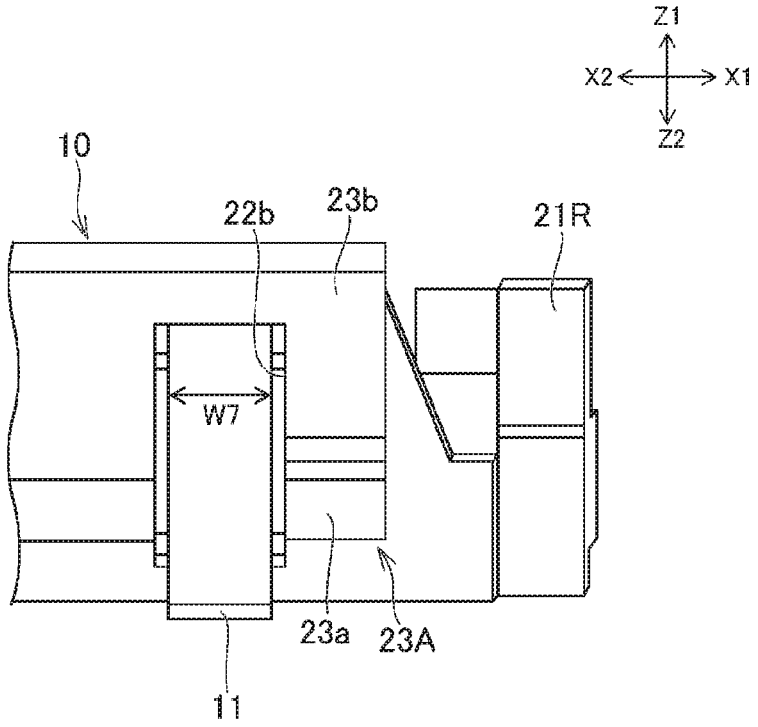
FIG. 6C is a front view of the first connector.
Figure 6D:
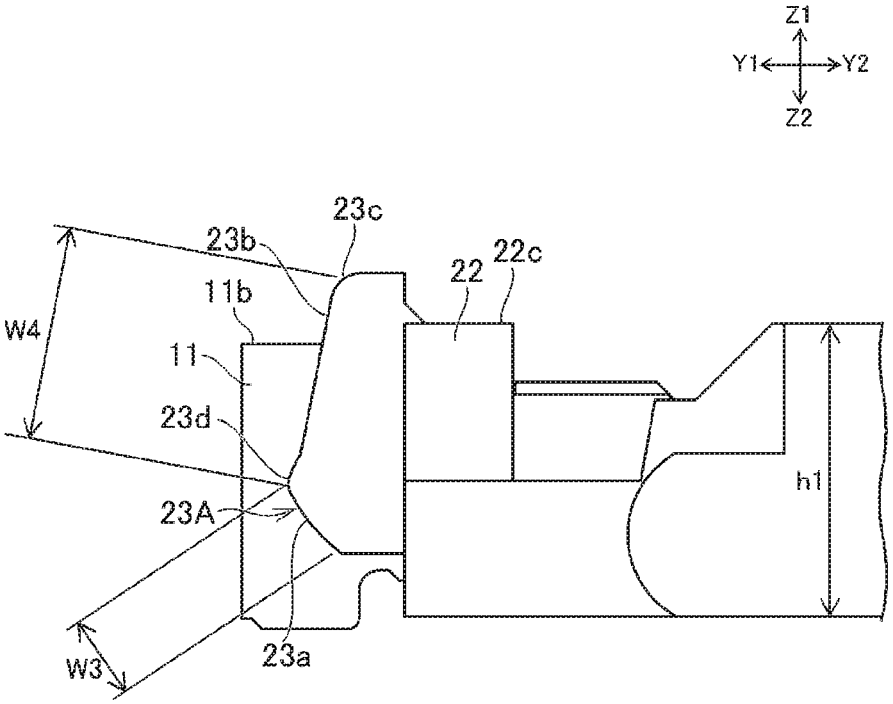
FIG. 6D is a side view of the first connector.

As illustrated in FIG. 6D, the first front engagement part 23A has a guide surface 23*b* which extends diagonally upward and rearward from the front end of the contact surface 23*a*. In the operation process of mating the second connector 60 with the first connector 10, the tip (lower end) of the second front engagement part 63A slides towards the contact surface 23*a* on this guide surface 23*b*.

As illustrated in FIG. 6D, the guide surface 23*b* has a relatively long length W4 in the vertical direction. Specifically, the length W4 of the guide surface 23*b* may be longer than the length W3 of the contact surface 23*a*. Moreover, the length W4 of the guide surface 23*b* may be longer than half the height h1 of the side wall 21R of the first connector 10. By lengthening the guide surface 23*b* in this way, any increase in the force (frictional force) acting on the second front engagement part 63A is moderated in the operation process of mating the second connector 60 with the first connector 10. In other words, the impact acting on the second front engagement part 63A can be moderated.

As illustrated in FIG. 6D, in the second connector 60, the position of the upper end 23*c* of the guide surface 23*b* may be higher than the upper end 22*c* of the front wall 22. This structure can prevent the tip (lower end) of the second front engagement part 63A of the second connector 60 from colliding with the upper end 22*c* of the front wall 22. The upper end 23*c* of the guide surface 23*b* may be higher than the position of the upper end 11*b* of the terminal 11.

The guide surface 23*b* of the second front engagement part 63A may have a projection 23*d* at the lowermost part thereof which swells forward. That is, the inclination of the guide surface 23*b* in the vertical direction is steeper in the projection 23*d*. According to this structure, in the operation process of mating the second connector 60 with the first connector 10, when the lower end of the second front engagement part 63A reaches the projection 23*d*, the force required to operate (rotate) the second connector 60 instantaneously increases; in contrast, when the lower end of the second front engagement part 63A exceeds the projection 23*d*, the force required to operate (rotate) the second connector 60 sharply drops. Such a drop in force enables an operator to recognize that the second front engagement part 63A has properly engaged with the first front engagement part 23A, without viewing the position of the tip (lower end) of the second front engagement part 63A.

As mentioned above, the terminal 11 is installed on the front wall 22 of the first connector 10. The terminal 11 is formed of metal and fixed to a conductive pad of the circuit substrate 101 when using the first connector 10. The first front engagement part 23A is formed on this the front wall 22. According to this structure, the terminal 11 can increase the strength of the front wall 22. Consequently, the front wall 22 can be prevented from being deformed when the second front engagement part 63A pushes the guide surface 23*b* of the first front engagement part 23A.

As illustrated in FIG. 6C, the first front engagement part 23A may be adjacent to the terminal 11. Specifically, the edge of the first front engagement part 23A may be congruent with the edge 22*b* of the hole 22*a* (FIG. 6A) with the terminal 11 fitted therein. More specifically, the first front engagement part 23A formed on the right is formed further on the right of the right terminal 11, while the left edge of the first front engagement part 23A may be congruent with the edge 22*b* of the hole 22*a*. In this way, because the position of the first front engagement part 23A is close to the terminal 11 and this terminal 11 is fixed to the circuit substrate 101, the position of the first front engagement part 23A can be effectively prevented from being recessed when the second front engagement part 63A pushes the guide surface 23*b* of the first front engagement part 23A.

Note that the member reinforcing the front wall 22 may not be the terminal 11. That is, a metal member which is not utilized for electrically connecting the circuit substrate 101 and the cable 90, but which is fixed (for example, soldered) to the circuit substrate 101, may be installed on the front wall 22.

As illustrated in FIG. 6B, the front wall 22 may have a reinforcing part 25 which is disposed between two first front engagement parts 23A, 23B and swells forward. The reinforcing part 25 is, for example, formed between two terminals 11. According to this structure, it is possible to increase the rigidity of the front connector 22. Consequently, in the operation process of mating the second connector 60 with the first connector 10, the front wall 22 can be prevented from being deformed when the second front engagement parts 63A, 63B push the guide surface 23*b* of the first front engagement parts 23A, 23B.

The reinforcing part 25 may have the same shape as the first front engagement parts 23A, 23B. That is, the reinforcing part 25 may have an inclined surface 25*a* which extends diagonally downward and forward. The height of the upper end of the inclined surface 25*a* is, for example, the same as the height of the guide surface 23*b* of the first front engagement part 23A (see FIG. 6D). The positions of the right and left ends of the reinforcing part 25 may be congruent with the edge of the hole 22*a* with the two terminals 11 fitted therein.

As illustrated in FIG. 7B, in the second connector 60, a front extension part 62 extends forward from a terminal holding part 61. In the mating state between the first connector 10 and the second connector 60, the front extension part 62 is formed so as to cover the entire upper side of the front wall 22 of the first connector 10. As illustrated in FIG. 7B, the second front engagement parts 63A, 63B are formed at the front edge of the front extension part 62. The second front engagement parts 23A, 23B extend downward from the front edge of the front extension part 62, with the lower part thereof bent downward and rearward.

As mentioned above, in the operation process of mating the second connector 60 with the first connector 10, the second front engagement parts 63A, 63B slide on the guide surface 23*b* against the frictional force between the tip (lower end) of the second front engagement parts 63A, 63B and the guide surface 23*b* of the first front engagement parts 23A, 23B. Therefore, the second front engagement parts 63A, 63B are preferably highly rigid.

As illustrated in FIG. 7B, the width W5 of the second front engagement part 63A in the anteroposterior direction may be larger than the width W6 of the second front engagement part 63A in the left and right direction. More specifically, in the base part of the second front engagement part 63A, the width W5 in the anteroposterior direction may be larger than the width W6 in the left and right direction. This shape enables an increase in the rigidity of the second front engagement part 63A. Consequently, in the operation process of mating the second connector 60 with the first connector 10, the second front engagement part 63A can be prevented from being deformed by the force received from the first front engagement part 23A. Moreover, the width W5 of the second front engagement part 63A in the anteroposterior direction may be larger than the width W7 (see FIG. 6C) of the terminal 11 in the left and right direction. This shape enables an increase in the rigidity of the second front engagement part 63A.

The position of the second front engagement part 63A in the left and right direction is close to the position of electric connection between the two connectors 10, 60. Specifically, the second front engagement part 63A is disposed so as to be closer to the center of the second connector 60 in the left and right direction compared with the second rear engagement part 64A. In other words, the positions of two second front engagement parts 63A, 63B in the left and right direction are between the left and right second rear engagement parts 64A, 64B. Therefore, as illustrated in FIG. 5, in the mating state between the two connectors 10, 60, the second front engagement parts 63A, 63B are respectively adjacent to the two terminals 11. Specifically, the right second front engagement part 63A is disposed further on the right of the right terminal 11, while the left second front engagement part 63B is disposed further on the left of the left terminal 11. Because the second front engagement parts 63A, 63B are close to the positions of the terminals 11 in this way, the second front engagement parts 63A, 63B engage with the first front engagement parts 23A, 23B near the terminals 11 and the cable terminals 91, enabling improved connection stability between the terminals 11 and the cable terminals 91. Moreover, in the operation process of mating the second connector 60 with the first connector 10, the relative displacement between the terminals 11 and the cable terminals 91 can be suppressed.

As illustrated in FIGS. 2B and 5, the front extension part 62 may have side walls 66 lowered from the right and left parts of the front extension part 62. In the mating state between the first connector 10 and the second connector 60, the upper part of the front wall 22 of the first connector 10 is disposed between the left and right side walls 66. According to this structure, the displacement in the left and right direction of the first connector 10 and the second connector 60 can be reduced by the side walls 66 and the front wall 22.

As illustrated in FIG. 5, the base parts of the second front engagement parts 63A, 63B may be connected to the side walls 66. That is, a coupling part 62*e* may be formed between the base parts of the second front engagement parts 63A, 63B and the side walls 66. This coupling part 62*e* can further increase the rigidity of the second front engagement parts 63A, 63B. In the example of the first connector 10, because the second front engagement parts 63A, 63B are connected to the side walls 66 via the coupling part 62*e*, the lengths of the left and right edges of the second front engagement parts 63A, 63B are different. That is, the coupling part 62*e* is formed further on the right of the second front engagement part 63A formed on the right. As a result, the length of the right edge 63*d* of the second front engagement part 63A is shorter than that of the left edge 63*c*. In contrast, the coupling part 62*e* is formed further on the left of the second front engagement part 63B formed on the left. As a result, the length of the left edge 63*d* of the second front engagement part 63B is shorter than that of the right edge 63*c*.

Figure 9A:
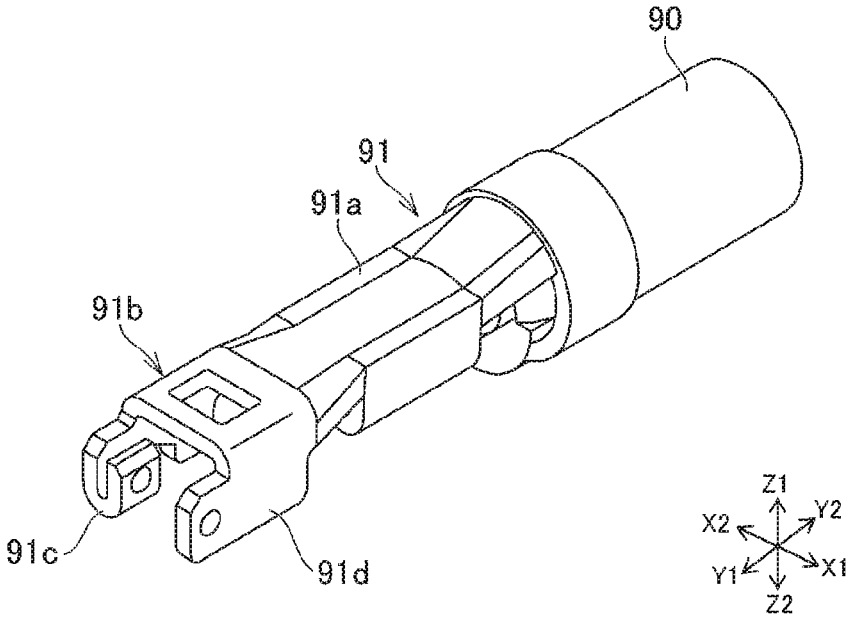
FIG. 9A is a perspective view of a cable terminal.
Figure 9B:
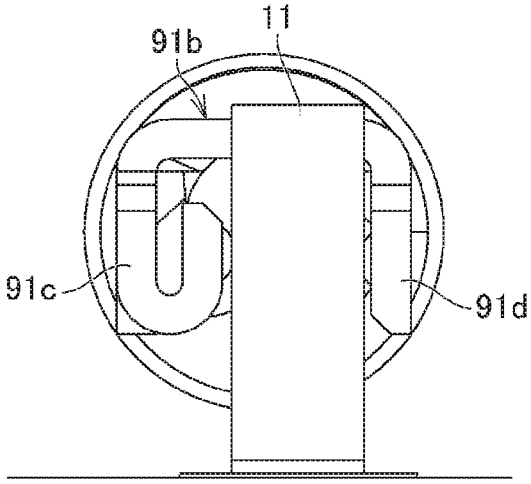
FIG. 9B is a front view illustrating the state in which the cable terminal and a terminal of the first connector are connected.

The cable terminal 91 is fitted in the holding hole 61*a* which is formed in the terminal holding part 61 of the second connector 60. As illustrated in FIG. 9A, the cable terminal 91 may have a core wire connection part 91*a* which holds the core wire of the cable 90 so as to be connected to the core wire. Moreover, the cable terminal 91 may have a terminal connection part 91*b* which is formed in front of a connection part 91*a* so as to sandwich the terminal 11 in the left and right direction. The terminal connection part 91*b* may have a first contact part 91*c* which contacts one side face of the terminal 11, along with a second contact part 91*d* contacting the side face on the opposite side thereof. As illustrated in FIG. 9B, the first contact part 91*c* may be formed in a substantially U shape so as to be elastically deformable. The first contact part 91*c* is pressed on the side face of the terminal 11 using the elastic force thereof. In contrast, the second contact part 91*d* may be plate shaped. In this way, because only one of the two contact parts 91*c*, 91*d* may be an elastically deformable shape, the width of the cable terminal 91 can be reduced compared with the case in which both the two contact parts 91*c*, 91*d* are made elastically deformable. Consequently, the second connector 60 and the first connector 10 can be miniaturized.

As described above, the connector assembly 1 includes: a first connector 10 which can be mounted on a circuit substrate 101, and a second connector 60 which is capable of mating with the first connector 10 in the vertical direction and holds a cable terminal 91 provided at the end of a cable 90, wherein the cable 90 is capable of being connected to the second connector 60 so as to extend rearward. The first connector 10 has first rear engagement parts 24A, 24B exposed towards the rear of the first connector 10, along with first front engagement parts 23A, 23B exposed towards the front of the first connector 10. A second connector 60 has second rear engagement parts 64A, 64B and second front engagement parts 63A, 63B. In the mating state between the first connector 10 and the second connector 60, the second rear engagement parts 64A, 64B are disposed on the rear side of the first rear engagement parts 24A, 24B so as to engage with the first rear engagement parts 24A, 24B, while the second front engagement parts 63A, 63B are disposed on the front side of the first front engagement parts 23A, 23B so as to engage with the first front engagement parts 23A, 23B.

In this way, in the connector assembly 1, because the second rear engagement parts 64A, 64B are respectively disposed on the rear side of the first rear engagement parts 24A, 24B so as to engage with the first rear engagement parts 24A, 24B, an operator can rotate the second connector 60 about the second rear engagement parts 64A, 64B. Moreover, because the second front engagement parts 63A, 63B are disposed on the front side of the first front engagement parts 23A, 23B, the direction D2 of the force acting when the cable 90 is pulled is significantly different from the direction D1 for disengaging the second front engagement parts 63A, 63B and the first front engagement parts 23A, 23B. As a result, two connectors 10, 60 can be effectively prevented from separating when the cable 90 is pulled. Moreover, in the first connector 10, the first rear engagement parts 24A, 24B are exposed towards the rear of the first connector 10. As a result, in the operation process of mating the second connector 60 with the first connector 10, the operator can easily abut the second rear engagement parts 64A, 64B against the first rear engagement parts 24A, 24B, thereby improving the workability.

The connector assembly proposed in the present disclosure is not restricted to the example of the abovementioned connector assembly 1.

For example, one or more of the engagement parts 23A, 23B, 24A, 24B, 63A, 63B, 64A, and 64A may be made of metal members. For example, the metal members may be installed at the rear ends of the side walls 21R, 21L of the first connector 10 and utilized as the first rear engagement parts 24A, 24B.

The invention claimed is:

1. A connector assembly comprising:

a first connector which can be mounted on a circuit substrate; and a second connector which is capable of mating with the first connector in the vertical direction and holds a cable terminal provided at the end of a cable, wherein the cable is capable of being connected to the second connector so as to extend rearward, wherein the first connector has a first rear engagement part exposed towards the rear of the first connector, along with a first front engagement part exposed towards the front of the first connector, the second connector has a second rear engagement part and a second front engagement part, and, in the mating state between the first connector and the second connector, the second rear engagement part is disposed on the rear side of the first rear engagement part so as to engage with the first rear engagement part, while the second front engagement part is disposed on the front side of the first front engagement part so as to engage with the first front engagement part, and wherein one front engagement part of the first front engagement part and the second front engagement part has a contact surface which abuts the other front engagement part and extends diagonally forward and upward, and wherein the second rear engagement part has a contact surface which abuts the first rear engagement part and is curved, and wherein the first rear engagement part has an inclined surface which extends rearward and upward from the position abutting the contact surface.

2. The connector assembly according to claim 1, wherein the first connector has a reinforcing metal fitting adjacent to the first rear engagement part.

3. The connector assembly according to claim 1, wherein the first front engagement part has the contact surface abutting the second front engagement part, along with a guide surface which extends diagonally upward and rearward from the contact surface.

4. The connector assembly according to claim 1, wherein:

the first connector has a front wall with the first front engagement part formed thereon, and a metal member is installed on the front wall.

5. The connector assembly according to claim 1, wherein a width of the second front engagement part in an anteroposterior direction is larger than a width of the second front engagement part in a left and right direction.

* * * * *